US007275997B2

(12) United States Patent
Hsia

(10) Patent No.: US 7,275,997 B2
(45) Date of Patent: Oct. 2, 2007

(54) SWING DEVICE WITH A DRIVING UNIT

(76) Inventor: Ben M. Hsia, c/o MTS Products, 10671 Lanark St., Sun Valley, CA (US) 91352

( * ) Notice: Subject to any disclaimer, the term of this patent is extended or adjusted under 35 U.S.C. 154(b) by 17 days.

(21) Appl. No.: 10/939,349

(22) Filed: Sep. 14, 2004

(65) Prior Publication Data

US 2006/0111193 A1 May 25, 2006

(30) Foreign Application Priority Data

Jul. 14, 2004 (TW) ..... 93211088 A

(51) Int. Cl.
*A63G 9/16* (2006.01)

(52) U.S. Cl. ..... 472/119; 5/108

(58) Field of Classification Search ..... 472/118–125; 297/273; 5/108, 109
See application file for complete search history.

(56) References Cited

U.S. PATENT DOCUMENTS 5,378,196 A * 1/1995 Pinch et al. ..... 472/119
5,846,136 A * 12/1998 Wu ..... 472/119
6,022,277 A * 2/2000 Jankowski ..... 472/119
6,544,128 B1 * 4/2003 Yang ..... 472/119
6,626,766 B1 * 9/2003 Hsia ..... 472/119
2006/0030415 A1 * 2/2006 Waldman et al. ..... 472/119

* cited by examiner

*Primary Examiner*—Kien Nguyen
(74) *Attorney, Agent, or Firm*—Morgan, Lewis & Bockius LLP

(57) ABSTRACT

A swing device includes a seat member, a pair of swing arms that are connected to the seat member, and a driving unit including an axle that is secured to one of the swing arms, a swingable member that is secured to the axle, a pair of studs that project from the swingable member, and a driving element including a driving rod that has a bent middle segment and two opposite bent end segments, each of which extends from the middle segment in a first direction away from the middle segment, passes over a respective one of the studs, and then turns in a second direction toward the respective one of the studs, and each of which has a free end portion that is disposed adjacent to and that is engageable with the respective one of the studs.

2 Claims, 9 Drawing Sheets

SWING DEVICE WITH A DRIVING UNIT

BACKGROUND OF THE INVENTION

1. Field of the Invention

The present invention relates to a swing device, more particularly to a swing device with a driving unit for swinging a seat member.

2. Description of the Related Art

FIGS. 1 to 4 illustrate a conventional swing device that is disclosed in U.S. Pat. No. 6,626,766. The conventional swing device includes a supporting frame 1, a seat member 3, and a pair of swing arms 2 that are connected to the seat member 3 and that are pivoted to the supporting frame 1 so as to permit swinging of the seat member 3 relative to the supporting frame 1. Two driving units 6 are mounted on the supporting frame 1 for driving the swing arms 2. Each of the driving units 6 includes an axle 51 that is secured to a respective one of the swing arms 2, a swingable member 50 that is coaxially secured to the axle 51 and that is swingable relative to the supporting frame 1, and a driving element 61 that is sleeved rotatably on the axle 51 for driving the swingable member 50 together with the swing arms 2 and the seat member 3 to swing. A pair of studs 522 project from the swingable member 50 toward the driving element 61. The driving element 61 includes a driver-mounting plate 612 that is formed with a slot 62, and a stiff driving rod 65 that is mounted on the driver-mounting plate 612 and that has an inverted U-shaped middle segment 651 and two opposite end segments 652 which extend from two opposite ends of the inverted U-shaped middle segment 651 and which are disposed respectively adjacent to the studs 522 in such a manner that swinging of the driver-mounting plate 612 relative to the axle 51 in a first direction results in pushing of one of the studs 522 by an adjacent one of the end segments 652 of the driving rod 65, thereby resulting in swinging of the swingable member 50 in the first direction, and that swinging of the driver-mounting plate 612 in a second direction opposite to the first direction results in pushing of the other of the studs 522 by the other of the end segments 652 of the driving rod 65, thereby resulting in swinging of the swingable member 50 in the second direction. The driver-mounting plate 612 is coupled to a motor 31 through a gear unit 40. A pushing cylinder 44 is mounted on a worm gear 41 of the gear unit 40, and projects therefrom through the slot 62 in the driver-mounting plate 612 for driving the driver-mounting plate 612 to swing. In operation, the driver-mounting plate 612 is driven by the motor 31 through the gear unit 40 and the pushing cylinder 44 so as to swing back and forth, which, in turn, results in swinging of the swingable member 50.

The conventional swing device is disadvantageous in that the pushing action acting on the studs 522 by the respective end segments 652 of the driving rod 65 is relatively stiff, which can result in a rough swinging movement of the seat member 3.

The entire disclosure of U.S. Pat. No. 6,626,766 is incorporated herein by reference.

SUMMARY OF THE INVENTION

The object of the present invention is to provide a swing device with an improved driving rod that is capable of providing a smooth swinging movement of the seat member during use and that is capable of overcoming the aforesaid disadvantage of the conventional swing device.

Accordingly, a swing device of the present invention includes: a supporting frame; a seat member; a pair of opposing swing arms that are connected to the seat member and that are pivoted to the supporting frame so as to permit swinging of the seat member relative to the supporting frame; and a driving unit mounted on the supporting frame, and including an axle that is secured to one of the swing arms, a swingable member that is coaxially secured to the axle and that is swingable relative to the supporting frame, a pair of studs that project from the swingable member, and a driving element including a driver-mounting plate that is sleeved rotatably on the axle so as to be swingable relative to the axle, and a driving rod that is mounted on the driver-mounting plate and that is engageable with the studs so as to drive the swingable member to swing upon swinging of the driver-mounting plate. The driving rod has a bent middle segment that is mounted on the driver-mounting plate, and two opposite bent end segments, each of which extends from the middle segment in a first direction away from the middle segment, passes over a respective one of the studs, and then turns in a second direction toward the respective one of the studs, and each of which has a free end portion that is disposed adjacent to the respective one of the studs in such a manner that swinging of the driver-mounting plate in a first rotational direction results in pushing of a corresponding one of the studs by the free end portion of the respective one of the bent end segments, thereby permitting the swingable member to swing in the first rotational direction, and that swinging of the driver-mounting plate in a second rotational direction opposite to the first rotational direction results in pushing of the other of the studs by the free end portion of the other of the bent end segments, thereby permitting the swingable member to swing in the second rotational direction.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
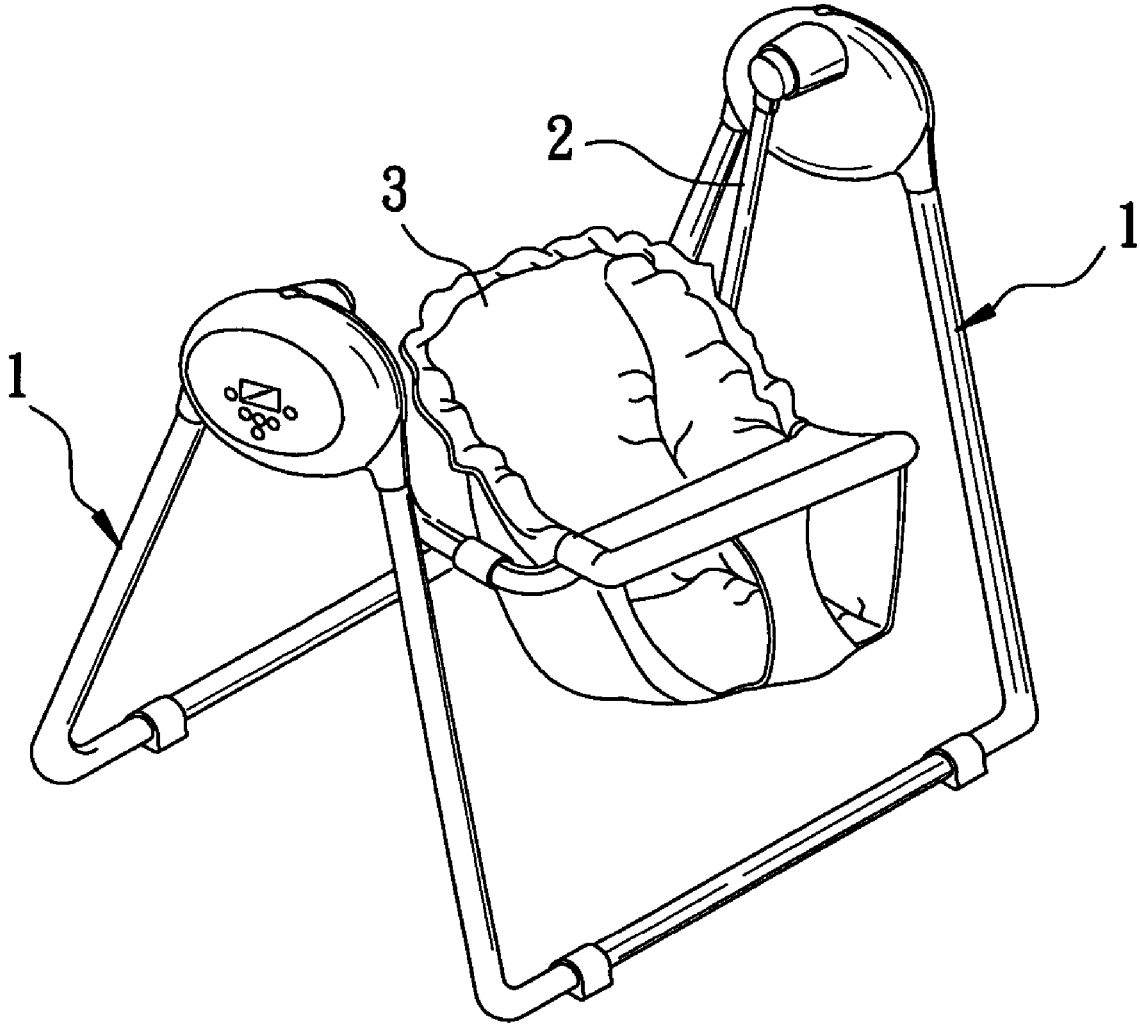
FIG. 1 PRIOR ART
FIG. 1 is a perspective view of a conventional swing device.
Figure 2:
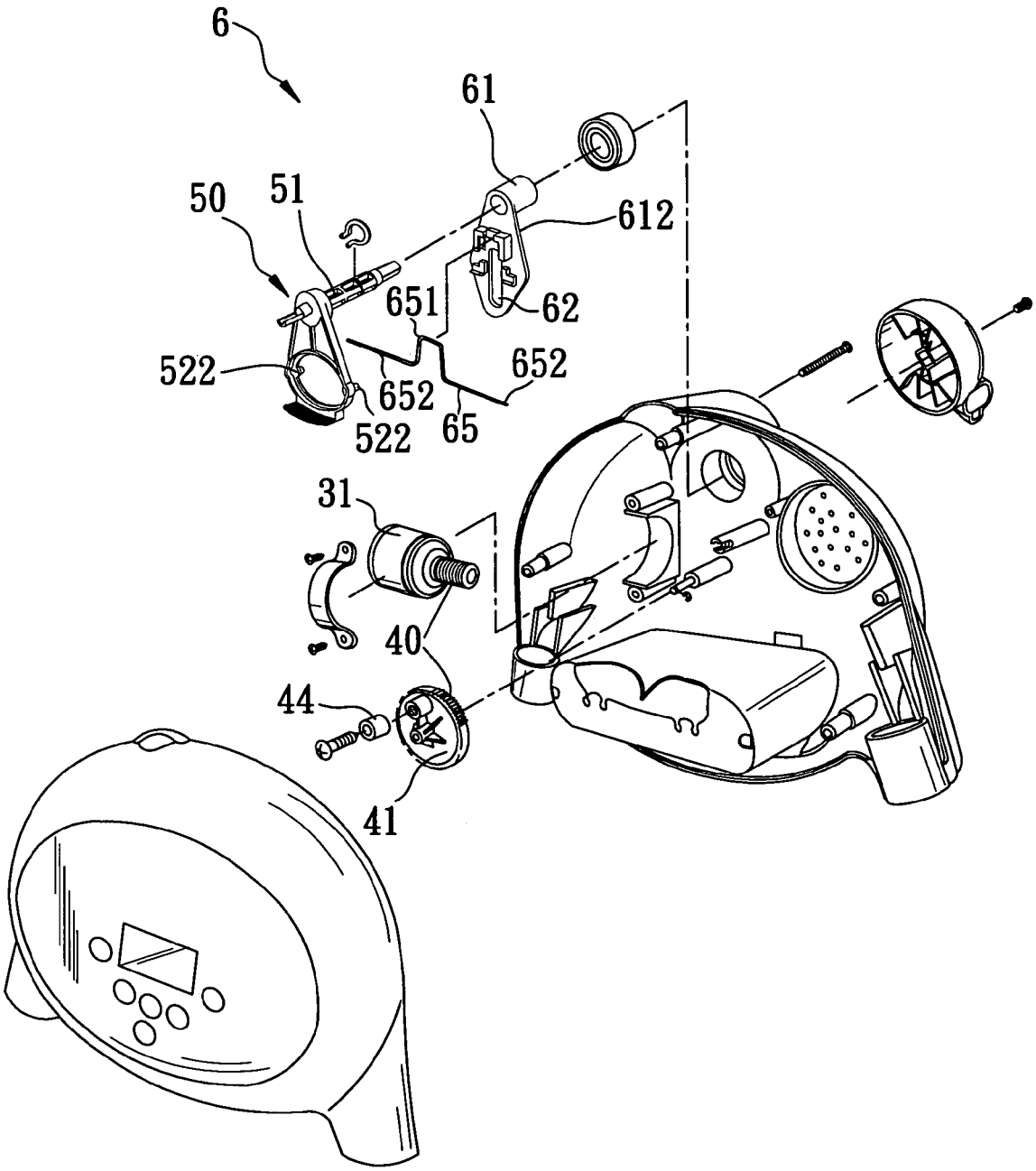
FIG. 2 PRIOR ART
FIG. 2 is an exploded perspective view of a driving unit of the conventional swing device.
Figure 3:
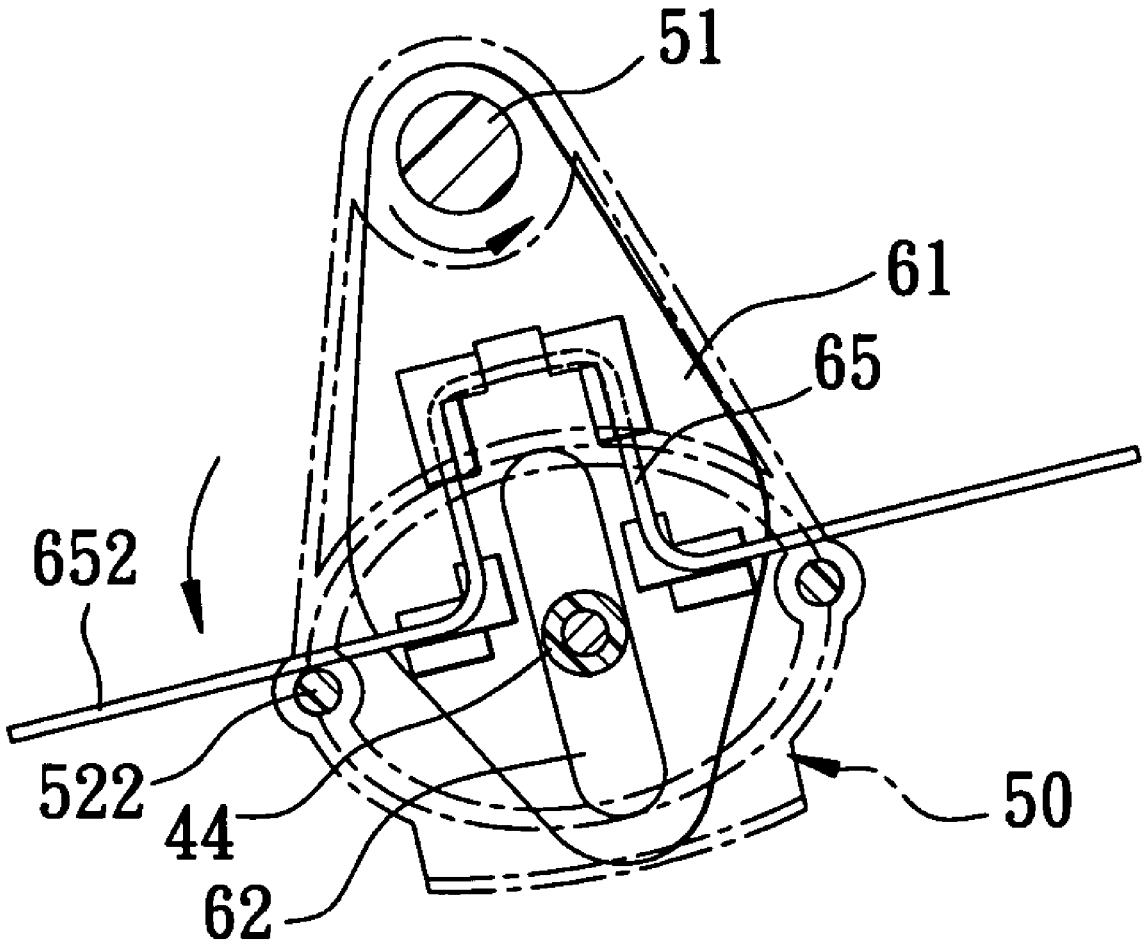
FIG. 3 PRIOR ART
FIG. 3 is a schematic side view to illustrate how a driving element drives a swingable member of the driving unit of FIG. 2 to move in a first rotational direction.
Figure 4:
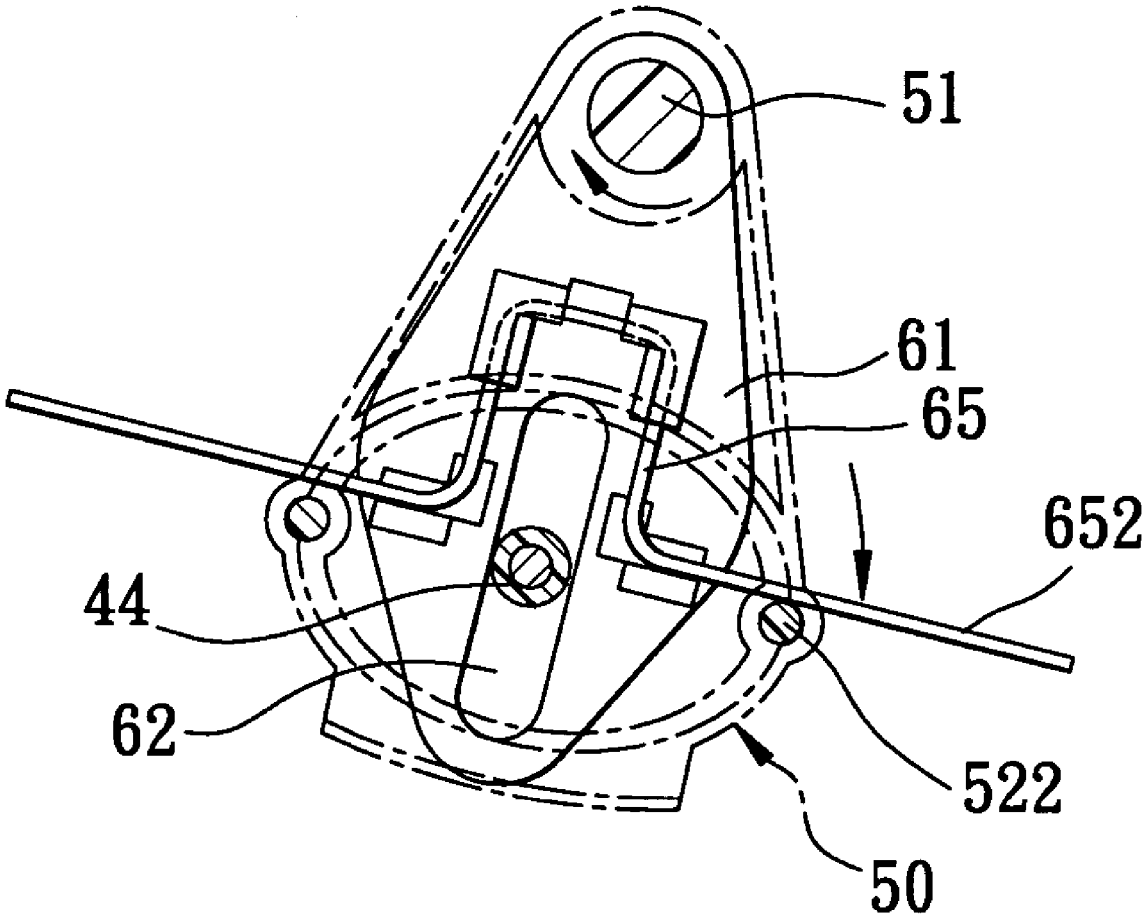
FIG. 4 PRIOR ART
FIG. 4 is a schematic side view to illustrate how the driving element drives the swingable member of the driving unit of FIG. 2 to move in a second rotational direction.
Figure 5:
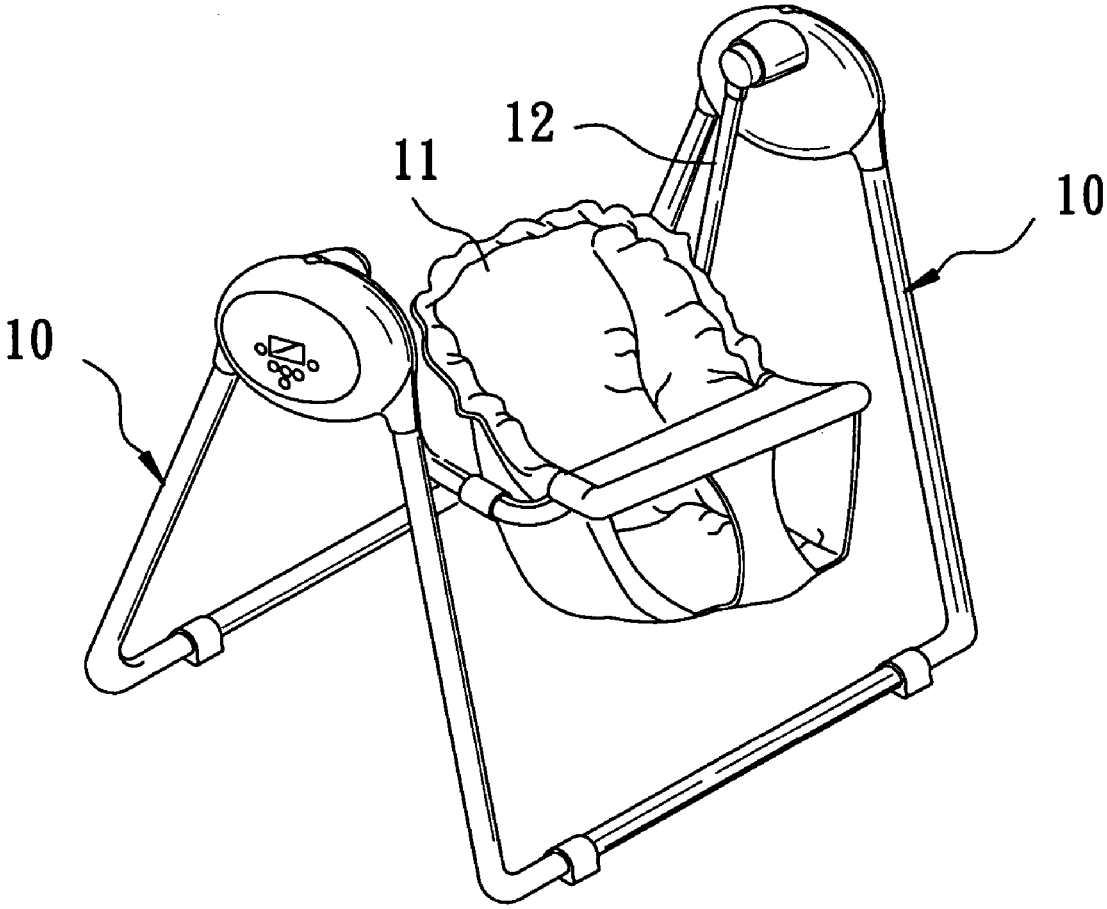
FIG. 5 is a perspective view of the preferred embodiment of a swing device according to this invention.
Figure 6:
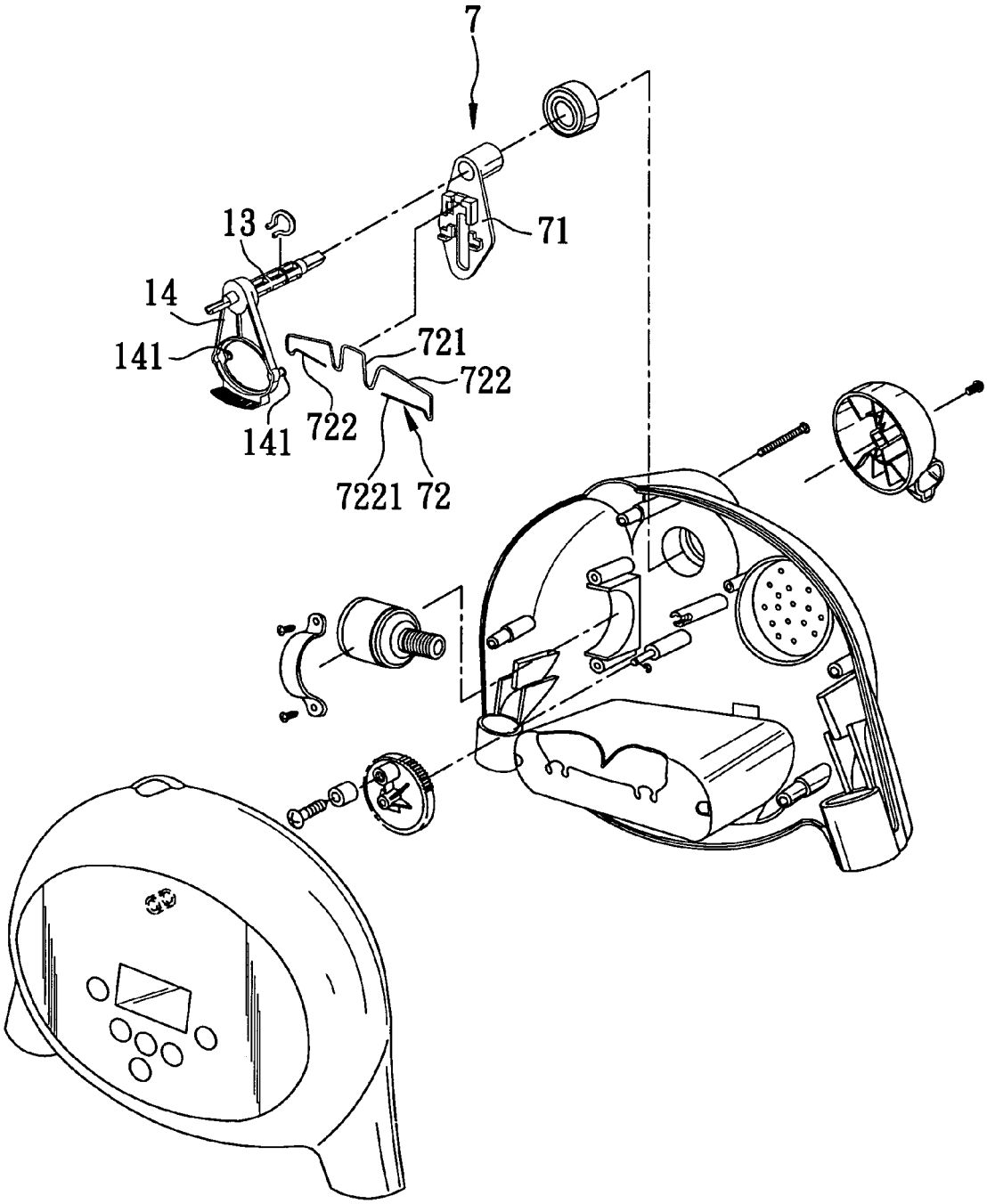
FIG. 6 is an exploded perspective view of a driving unit of the preferred embodiment.
Figure 7:
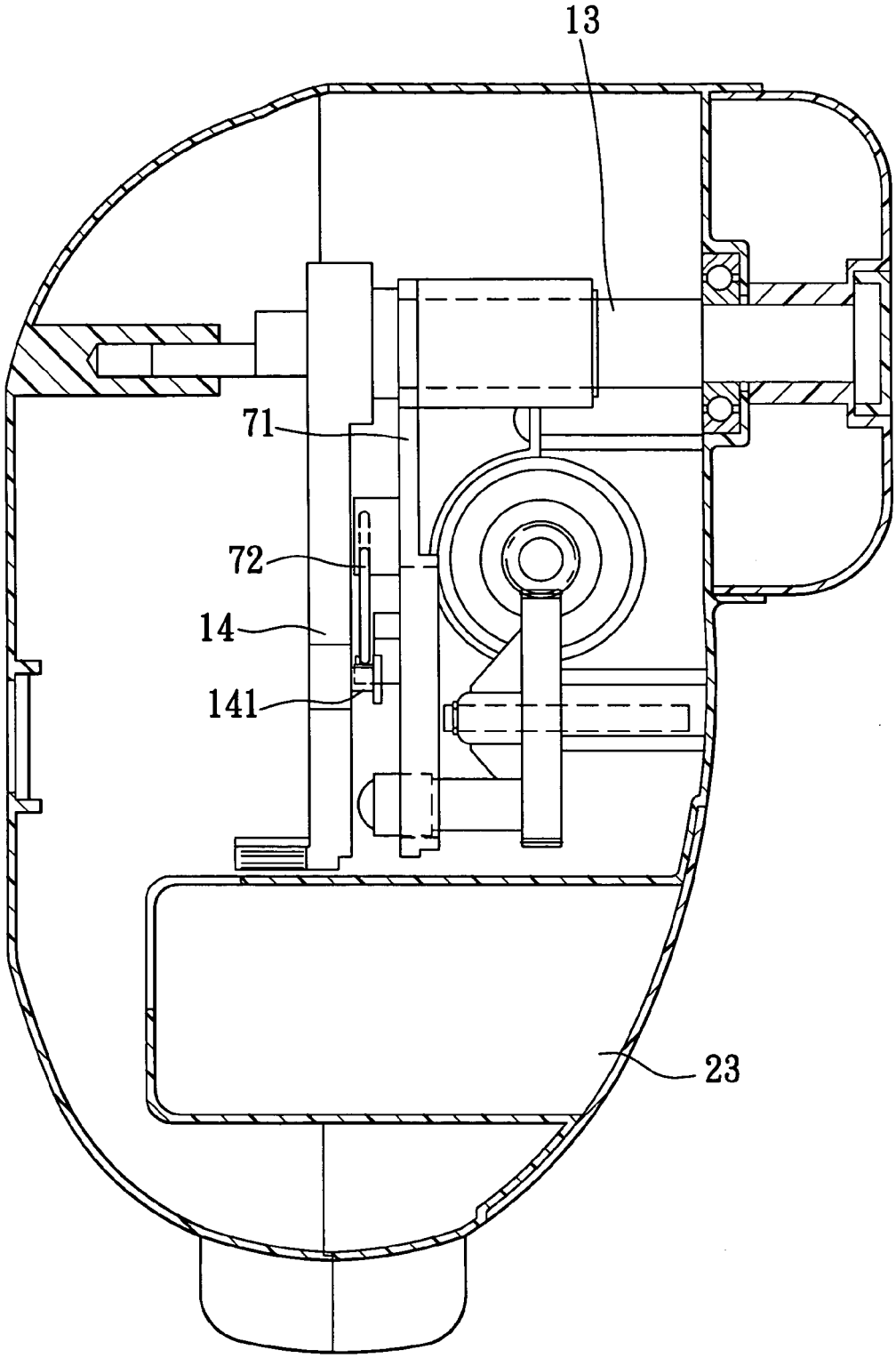
FIG. 7 is a sectional view of the preferred embodiment.
Figure 8:
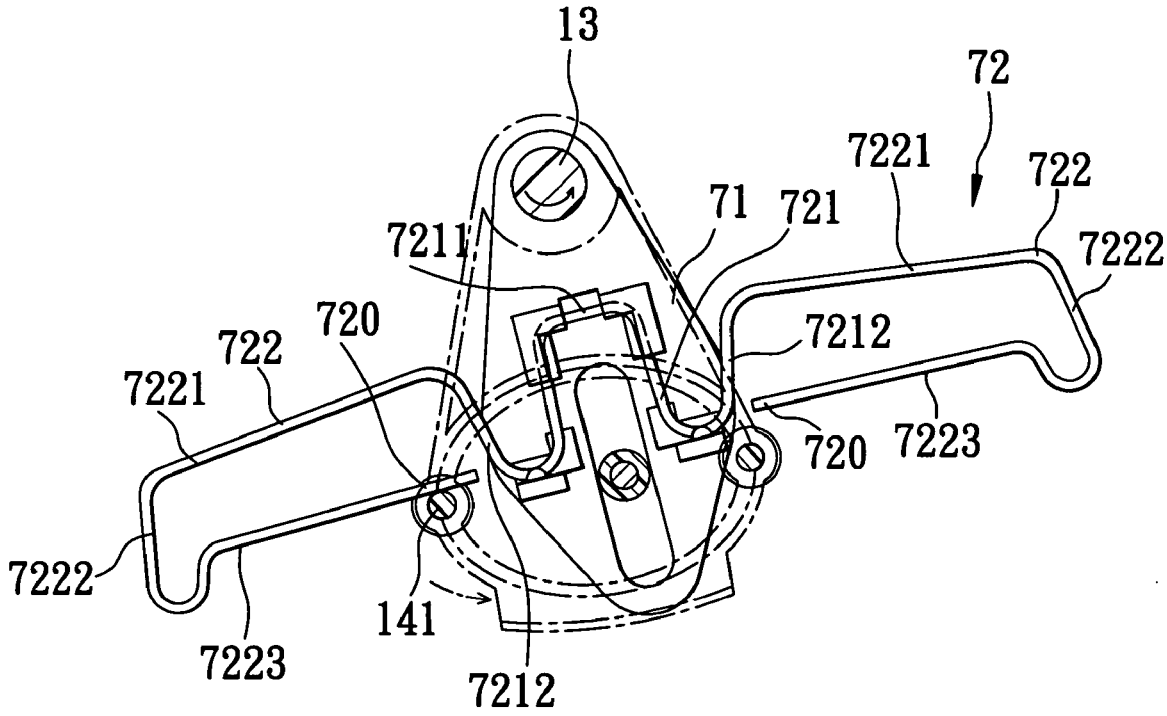
FIG. 8 is a schematic side view to illustrate how a driving element drives a swingable member of the driving unit of FIG. 6 to move in a first rotational direction.
Figure 9:
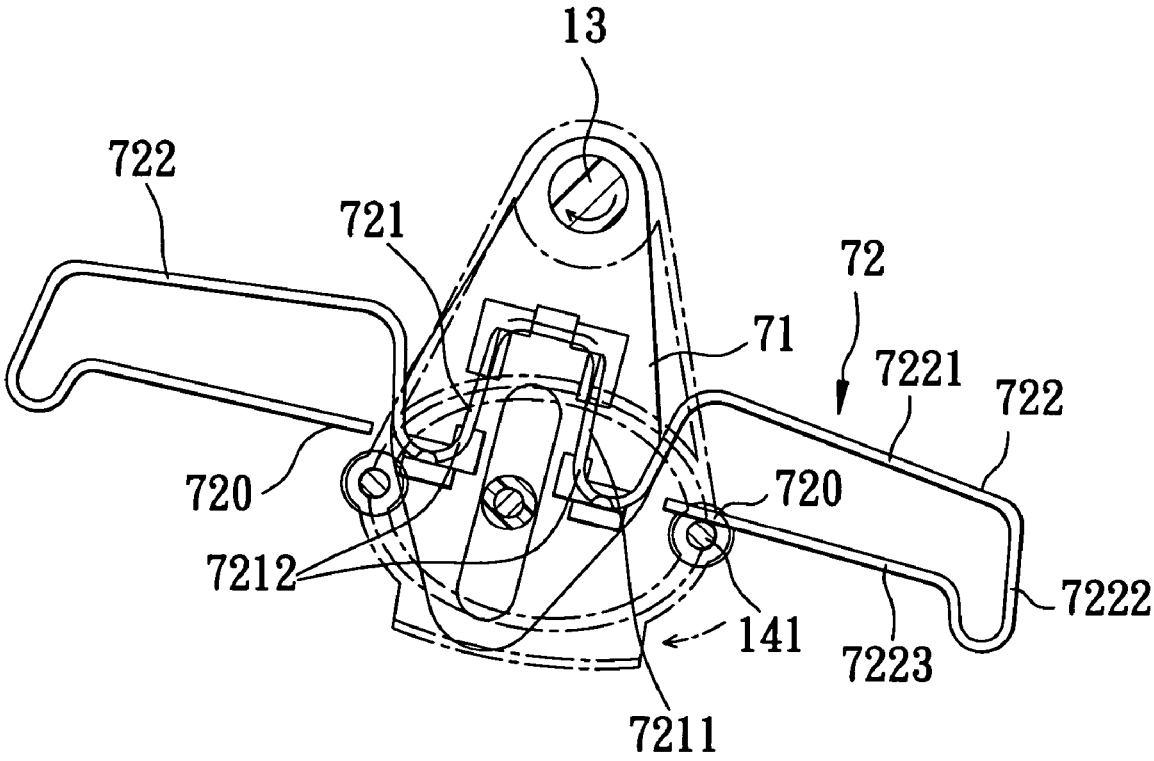
FIG. 9 is a schematic side view to illustrate how the driving element drives the swingable member of the driving unit of FIG. 6 to move in a second rotataional direction.

FIGS. 5 to 9 illustrate the preferred embodiment of a swing device according to the present invention.

The swing device includes: a supporting frame 10; a seat member 11; a pair of opposing swing arms 12 that are connected to the seat member 11 and that are pivoted to the supporting frame 10 so as to permit swinging of the seat member 11 relative to the supporting frame 10; and two driving units, each of which is mounted on the supporting frame 10, and each of which includes an axle 13 that is secured to a respective one of the swing arms 12, a swingable member 14 that is coaxially secured to the axle 13 and that is swingable relative to the supporting frame 10, a pair of studs 141 that project from the swingable member 14, and a driving element 7 including a driver-mounting plate 71 that is sleeved rotatably on the axle 13 so as to be swingable relative to the axle 13, and a driving rod 72 that is mounted on the driver-mounting plate 71 and that is engageable with the studs 141 so as to drive the swingable member 14 to swing upon swinging of the driver-mounting plate 71. The driving rod 72 is made from a stiff material, and has a bent middle segment 721 that is mounted on the driver-mounting plate 71, and two opposite bent end segments 722, each of which extends from the middle segment 721 in a first direction away from the middle segment 721, passes over a respective one of the studs 141, and then turns in a second direction toward the respective one of the studs 141, and each of which has a free end portion 720 that is disposed adjacent to the respective one of the studs 141 in such a manner that swinging of the driver-mounting plate 71 in a first rotational direction results in pushing of a corresponding one of the studs 141 by the free end portion 720 of the respective one of the bent end segments 722, thereby permitting the swingable member 14 to swing in the first rotational direction, and that swinging of the driver-mounting plate 71 in a second rotational direction opposite to the first rotational direction results in pushing of the other of the studs 141 by the free end portion 720 of the other of the bent end segments 722, thereby permitting the swingable member 14 to swing in the second rotational direction.

In this embodiment, the middle segment 721 has an inverted U-shaped portion 7211 that has two opposite ends, and two U-shaped portions 7212 that respectively extend from the ends of the inverted U-shaped portion 7211. Each of the U-shaped portions 7212 of the middle segment 721 has a distal end that is distal from the inverted U-shaped portion 7211. Each of the bent end segments 722 has a first arm portion 7221 that extends from the distal end of an adjacent one of the U-shaped portions 7212 of the middle segment 721 in a first direction away from the middle segment 72, a bight portion 7222 that is bent from the first arm portion 7221, and a second arm portion 7223 that is disposed opposite to the first arm portion 7221, that is bent from the bight portion 7222, and that extends from the bight portion 7222 in a second direction toward the middle segment 721. The second arm portion 7223 of each of the bent end segments 722 has a free end portion that defines the free end portion 720 of the respective one of the bent end segments 722.

By virtue of the configuration of the middle segment 721 and the configuration of the bent end segments 722, the free end portion 720 of each of the bent end segments 722 is slightly elastically deformable when pressed, thereby providing a buffering effect on the pushing action of the free end portion 720 of each of the bent end segments 722 acting on the respective one of the studs 141, and thereby ensuring a much smoother swinging movement of the seat member 11 relative to the supporting frame 10 as compared to the aforesaid conventional swing device.

While the present invention has been described in connection with what is considered the most practical and preferred embodiment, it is understood that the present invention is not limited to the disclosed embodiments but is intended to cover various arrangement included within the spirit and scope of the broadest interpretation so as to encompass all such modifications and equivalent arrangements.

I claim:

1. A swing device comprising:

a supporting frame;

a seat member;

a pair of opposing swing arms that are connected to said seat member and that are pivoted to said supporting frame so as to permit swinging of said seat member relative to said supporting frame; and a driving unit mounted on said supporting frame, and including an axle that is secured to one of said swing arms, a swingable member that is coaxially secured to said axle and that is swingable relative to said supporting frame, a pair of studs that project from said swingable member, and a driving element including a driver-mounting plate that is sleeved rotatably on said axle so as to be swingable relative to said axle, and a driving rod that is mounted on said driver-mounting plate and that is engageable with said studs so as to drive said swingable member to swing upon swinging of said driver-mounting plate;

wherein said driving rod has a bent middle segment that is mounted on said driver-mounting plate, and two opposite bent end segments, each of which extends from said middle segment in a first direction away from said middle segment, passes over a respective one of said studs, and then turns in a second direction toward the respective one of said studs, and each of which has a free end portion that is disposed adjacent to the respective one of said studs in such a manner that swinging of said driver-mounting plate in a first rotational direction results in pushing of a corresponding one of said studs by said free end portion of the respective one of said bent end segments, thereby permitting said swingable member to swing in said first rotational direction, and that swinging of said driver-mounting plate in a second rotational direction opposite to said first rotational direction results in pushing of the other of said studs by said free end portion of the other of said bent end segments, thereby permitting said swingable member to swing in said second rotational direction.

2. The swing device as defined in claim 1, wherein said middle segment has an inverted U-shaped portion that has two opposite ends, and two U-shaped portions that respectively extend from said ends of said inverted U-shaped portion, each of said U-shaped portions of said middle segment having a distal end that is distal from said inverted U-shaped portion, each of said bent end segments having a first arm portion that extends from said distal end of an adjacent one of said U-shaped portions of said middle segment in a first direction away from said middle segment, a bight portion that is bent from said first arm portion, and a second arm portion that is disposed opposite to said first arm portion, that is bent from said bight portion, and that extends from said bight portion in a second direction toward said middle segment, said second arm portion of each of said bent end segments having a free end portion that defines said free end portion of a respective one of said bent end segments.

* * * * *